US006371348B1

(12) United States Patent
Canlas et al.

(10) Patent No.: US 6,371,348 B1
(45) Date of Patent: Apr. 16, 2002

(54) FASTENER DRIVING DEVICE WITH ENHANCED SEQUENTIAL ACTUATION

(75) Inventors: Prudencio S. Canlas, North Kingstown; Donald R. Perron, North Smithfield, both of RI (US)

(73) Assignee: Stanley Fastening Systems, LP, East Greenwich, RI (US)

( * ) Notice: Subject to any disclaimer, the term of this patent is extended or adjusted under 35 U.S.C. 154(b) by 99 days.

(21) Appl. No.: 09/602,294

(22) Filed: Jun. 23, 2000

Related U.S. Application Data

(60) Provisional application No. 60/147,402, filed on Aug. 6, 1999.

(51) Int. Cl.[7] ..... B25C 1/04

(52) U.S. Cl. ..... 227/8; 227/130; 123/46 SC

(58) Field of Search ..... 227/8, 130, 120, 227/142; 123/46 SC

(56) References Cited

U.S. PATENT DOCUMENTS

| | | | | |
|---|---|---|---|---|
| 3,194,324 A | | 7/1965 | Langas | |
| 4,260,092 A | | 4/1981 | Austin | |
| 4,629,106 A | | 12/1986 | Howard et al. | |
| 5,083,694 A | | 1/1992 | Lemos | |
| 5,207,143 A | | 5/1993 | Monacelli | |
| 5,437,339 A | | 8/1995 | Tanaka | |
| 5,564,614 A | | 10/1996 | Yang | |
| 5,597,106 A | | 1/1997 | Hamano et al. | |
| 5,669,541 A | | 9/1997 | Ronconi | |
| 5,706,996 A | | 1/1998 | Lee | |
| 5,715,982 A | * | 2/1998 | Adachi | 227/142 |
| 5,791,545 A | * | 8/1998 | Lin | 227/130 |
| 5,836,501 A | * | 11/1998 | Lai | 227/8 |
| 5,862,969 A | * | 1/1999 | Lee | 227/130 |
| 5,865,360 A | * | 2/1999 | White | 227/8 |
| 6,059,161 A | * | 5/2000 | Chang et al. | 227/130 |
| 6,116,488 A | * | 9/2000 | Lee | 227/8 |

FOREIGN PATENT DOCUMENTS

GB 2 053 069 A 2/1981

* cited by examiner

*Primary Examiner*—Scott A. Smith
(74) *Attorney, Agent, or Firm*—Pillsbury Winthrop LLP

(57) ABSTRACT

A fastener driving device including a sequential activating arrangement in which an enabling member has one end pivotally connected to a trigger member, an opposite end operatively associated with an upper end of an upper structure of a work contact assembly and a central portion disposed below a lower end of an actuating member. When the enabling member and trigger member are in the inoperative limiting positions, thereof movement of the upper structure from the inoperative position thereof into the operative position thereof will move the opposite end of said enabling member through a first arcuate path into a first position. When in the first position, the enabling member is moved into a second position in response to the manual movement of the trigger member into the operative limiting position thereof during which the actuating member is moved into the operative position thereof. The enabling member is retained in the second position thereof so long as the trigger member and upper structure are retained in the operative limiting positions thereof. When in the second position, the enabling member is moved through a second arcuate path into a third position in response to the movement of the upper structure into the inoperative position therewith either by virtue of the normal rebound of the device at firing or by a manual movement of the device away from the workpiece.

24 Claims, 8 Drawing Sheets

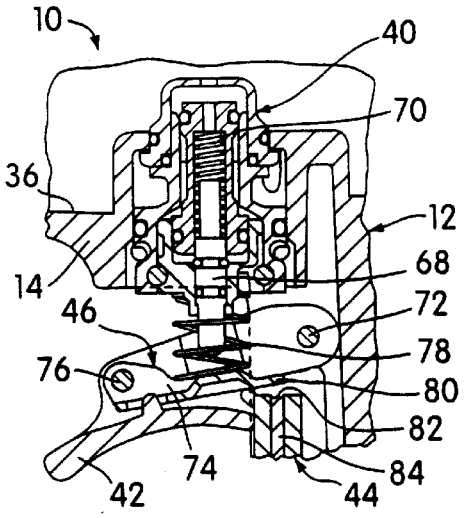
FIG. 9
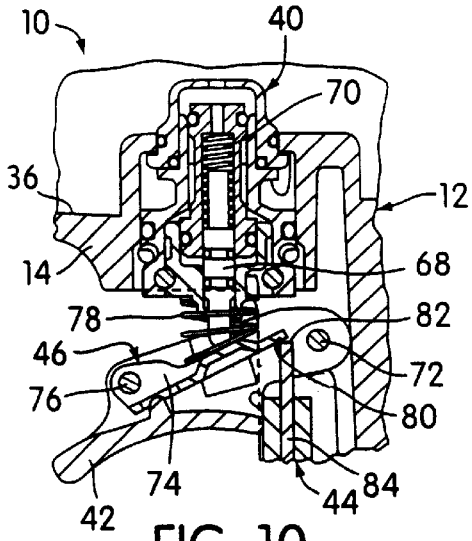
FIG. 10
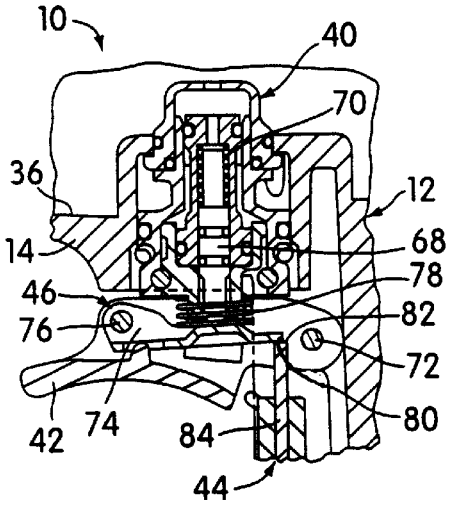
FIG. 11
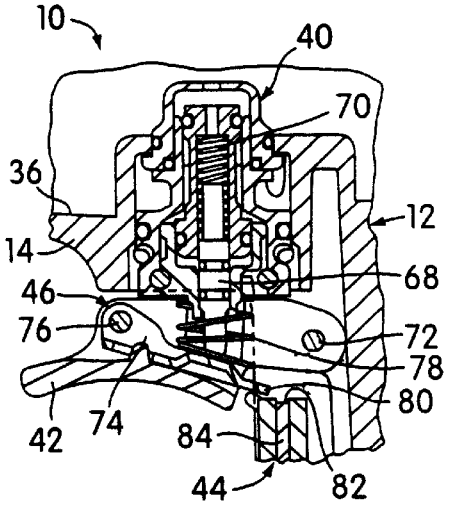
FIG. 12
FIG. 13
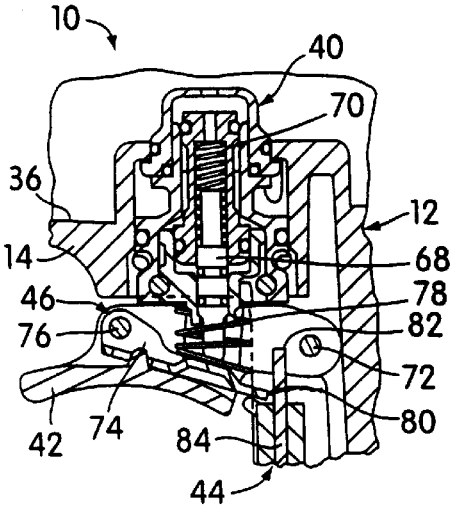

10
14
120
126
52
12
124
122
126
158
162
160
176
56
42
172
188
82
98
16
144
54
94
90
46
60
150
58
88
44

FASTENER DRIVING DEVICE WITH ENHANCED SEQUENTIAL ACTUATION

This application claims the benefit of U.S. Provisional Application No. 60/147,402, filed Aug. 6, 1999.

This invention relates to fastener driving devices and, more particularly, to fastener driving devices of the portable type.

BACKGROUND OF THE INVENTION

Portable type fastener driving devices of the type herein contemplated are the type that include a portable frame structure having nosepiece structure defining a fastener drive track, a fastener driving element slidably mounted in the drive track, a magazine assembly for feeding a supply of fasteners along a feed track so as to move a leading fastener into the drive track and a manually actuated fastener driving system for moving the fastener driving element through successive cycles each of which includes a drive stroke and a return stroke. The driving system usually involves some sort of power, such as a spring, electricity, combustible gases, or air under pressure. In the last four power modes, it is important to prevent inadvertent or unwanted power actuations. To this end, it is usual that actuation by the normal digitally moved trigger member is modified by the action of a work contact assembly which is actuated when the user moves the device into working relation with a workpiece. An enabling member is provided which cooperates with the actuating member, trigger member and work contact assembly to effect movement of the actuating member to actuate the power only if both the trigger member and work contact assembly are actuated.

In some arrangements, which have been referred to as concomitant arrangements, power actuation is made to occur when both actuations occur without regard as to which is first. Other arrangements have been referred to as sequential arrangements. In the sequential arrangement, power actuation will only occur when the work contact assembly is first actuated and then the trigger is actuated.

One problem that can occur even in sequential arrangements is that the recoil of the device can result in an unwanted double firing. This recognized problem has been dealt with in prior art arrangements, as, for example, in U.S. Pat. No. 5,669,541, the disclosure of which is hereby incorporated into the resent specification.

The arrangement disclosed in the '541 patent is an arrangement which can be selectively manually converted into either a concomitant operation mode or a sequential operation mode. In the sequential mode, the arrangement provides an intermediate enabling member which is pivotally mounted on the trigger member in a position so that a free end thereof will be moved up in a pivotal movement about its pivotal axis with the trigger member from a first position into a second position when the work contact structure is moved. This pivotal movement is insufficient to effect actuation which is accomplished when the trigger member is thereafter sequentially moved into an actuating position. The actuating position does not correspond to the final operative limiting position into which the trigger can be moved. Instead, there is provided a deliberate small amount of movement after the actuating position is reached before the trigger movement is stopped by arriving at its operative limiting position. His last small movement is used to move the free end of the rocker member out of contact with the work contacting structure so that it can be spring biased into an interim position out of the path of movement of the work contacting structure. Consequently, when the trigger member is in its operative limiting position at the end of a normal sequential actuating movement, the enabling member will be in the interim position out of the path of movement of the work contacting structure. In this way, double firing is prevented.

Applicant has found that an arrangement of this type is difficult to get into proper adjustment during assembly and tends to get out of adjustment once established. The amount of travel of the trigger beyond the actuating position must be enough to effect disengagement of the end of the rocker member with the work contact structure. Even so, the final movement is a relatively small amount of the total movement which must be manually imparted to the trigger. In terms of time, the final movement is accomplished almost instantaneously after actuation is commenced even before recoil occurs. There is a need to provide an arrangement by which double firing can be effectively prevented without requiring the delicate balance inherent in the operation of the prior art arrangement.

BRIEF DESCRIPTION OF THE INVENTION

It is an object of the present invention to fulfill the need discussed above. In accordance with the principles of the present invention, this objective is obtained by providing a fastener driving device comprising a frame structure presenting a handle portion constructed and arranged to be gripped by a user enabling the user to handle the device in portable fashion. Fixed with respect to the frame structure is nosepiece structure defining a fastener drive track. A fastener driving element is slidably mounted in the drive track. A manually actuated fastener driving system is carried by the frame structure which is constructed and arranged to move the fastener driving element through successive operating cycles each including a drive stroke and a return stroke. A magazine assembly is carried by the frame structure and has fixed structure defining a fastener feed track leading to the drive track and movable structure constructed and arranged to enable a package of fasteners to be loaded in the magazine assembly and fed along the feed track so that the leading fastener of the fastener package is moved into the drive track so as to be driven outwardly thereof into a workpiece during the drive stroke of the fastener driving element.

An actuating member is constructed and arranged with respect to the frame structure to be moved rectilinearly in a direction generally parallel with the drive track between a normally biased inoperative position and an operative limiting position thereabove. A trigger member is constructed and arranged with respect to the frame structure to be manually pivoted between an inoperative position and an operative position thereabove. A work contact assembly is constructed and arranged with respect to the frame structure to be moved from a normally biased inoperative position into an operative position in response to the movement of the device into cooperating engagement with a workpiece. The work contact assembly includes an upper structure movable along a generally rectilinear path between an inoperative position corresponding with the inoperative position of said work contact assembly and an operative position thereabove corresponding to the operative position of said work contact assembly. An enabling member has one end pivotally connected to the trigger member, an opposite end operatively associated with an upper end of the upper structure and a central portion disposed below a lower end of the actuating member. A spring is constructed and arranged with respect to the enabling member and the frame structure to bias the enabling member into a normal inoperative limiting position with respect to the trigger member.

The opposite end of the enabling member is constructed and arranged with respect to the upper end of the upper structure, so that when the enabling member and the trigger member are in the inoperative positions thereof, movement of the upper structure from the inoperative position thereof into the operative position will move the opposite end of the enabling member through a first arcuate path into a first position of the enabling member during which the central portion thereof in inoperable to move the actuating member into the operative position thereof. The enabling member when in the first position is constructed and arranged to move into a second position in response to the manual movement of the trigger member into the operative limiting position thereof during which the central portion of the enabling member is operable to move the actuating member into the operative position thereof.

When the enabling member is in the second position and the trigger member is retained in the operative limiting position thereof, the enabling member will be moved into a third position in response to a predetermined movement of the upper structure toward the inoperative position thereof either by virtue of the normal rebound of the device at firing or by a manual movement of the device away from the workpiece.

The opposite end of the enabling member is movable through a second arcuate path during the movement of the enabling member from the second position thereof into the third position thereof so as to be out of the rectilinear path of the upper structure if the upper structure is moved back into the operative position thereof while the trigger member is retained in the operative limiting position thereof. The opposite end of the enabling member when the enabling member in the third position being biased to move through a third arcuate path by the release of the trigger member from the manual movement thereof into the operative limiting position thereof. The third arcuate path of movement of the enabling member is configured to move the opposite end of the enabling member (1) into a position overlying the upper end of the upper structure when the upper structure is disposed in the inoperative position thereof and (2) into abutting engagement the said upper structure when the upper structure is in the operative limiting position thereof.

By establishing a relationship between the enabling member, the trigger member and the work contacting upper structure in which the event that initiates the return stroke of the fastener driving element is the recoil itself rather than a prior manual trigger member movement, double firing is prevented without the necessity of dealing with the highly critical timing balance heretofore required.

Other objects of the present invention are to provide a device of the type describe above which is combined with other features hereafter described in detail.

BRIEF DESCRIPTION OF THE DRAWINGS

FIG. 9 is a fragmentary sectional view showing the trigger valve assembly with the trigger member, work contact assembly and enabling member in the normal inoperative positions thereof;

FIG. 10 is a view similar to FIG. 9 showing the position of the parts after the movement of the work contact assembly into the operative position thereof;

FIG. 11 is a view similar to FIG. 10 showing the position of the parts after the movement of the trigger member into the operative position thereof;

FIG. 12 is a view similar to FIG. 11 showing the position of the parts after the movement of the work contact assembly back into the inoperative position thereof;

FIG. 13 is a view similar to FIG. 12 showing the position of the parts after the movement of the work contact assembly into the operative position thereof with the trigger member having been first moved into the operative position thereof;

DETAILED DESCRIPTION OF THE PREFERRED EMBODIMENT

Figure 1:
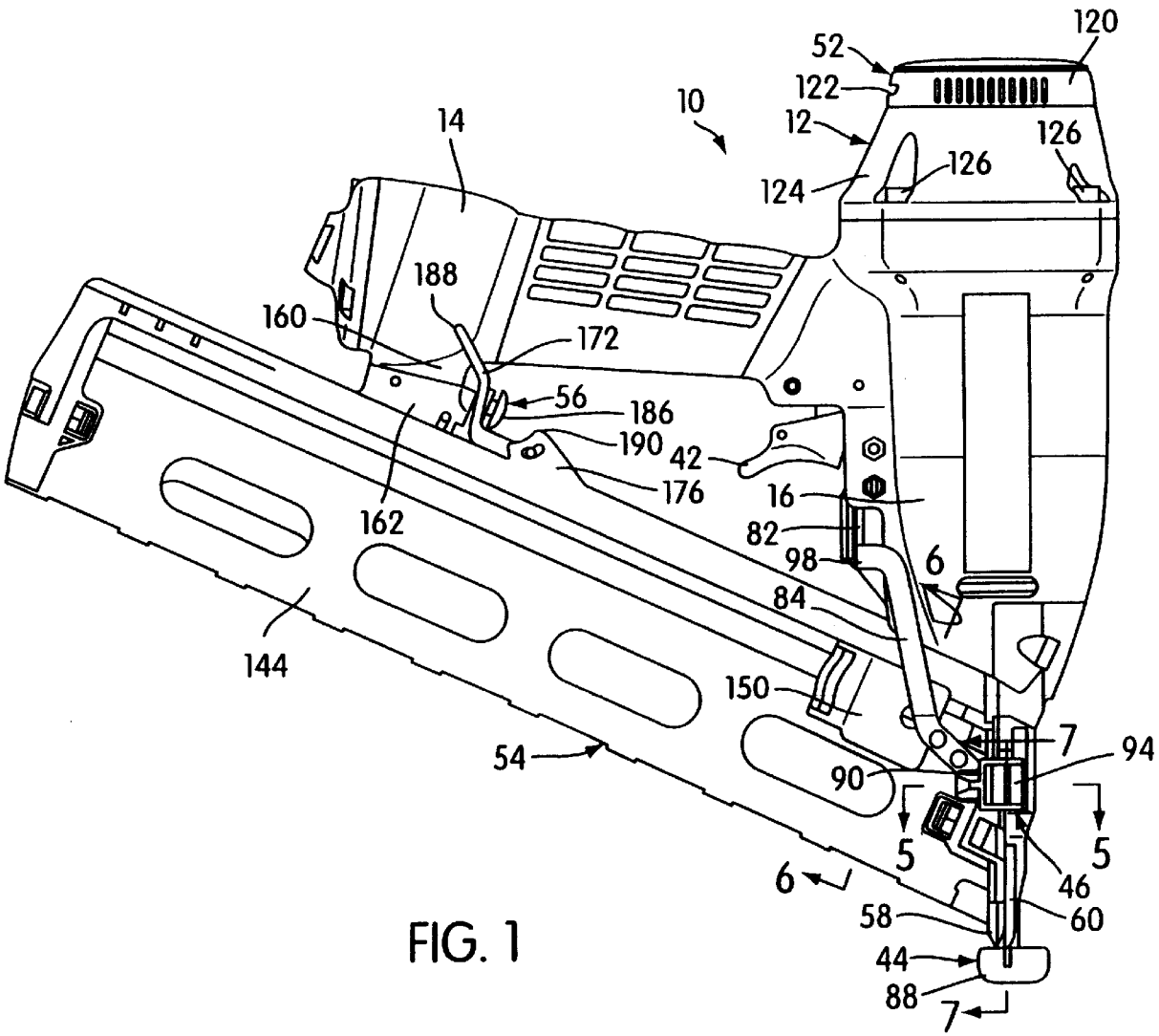
FIG. 1 is a side elevational view of a fastener driving device embodying the principles of the present invention with the parts in the normal inoperative position thereof.
Figure 2:
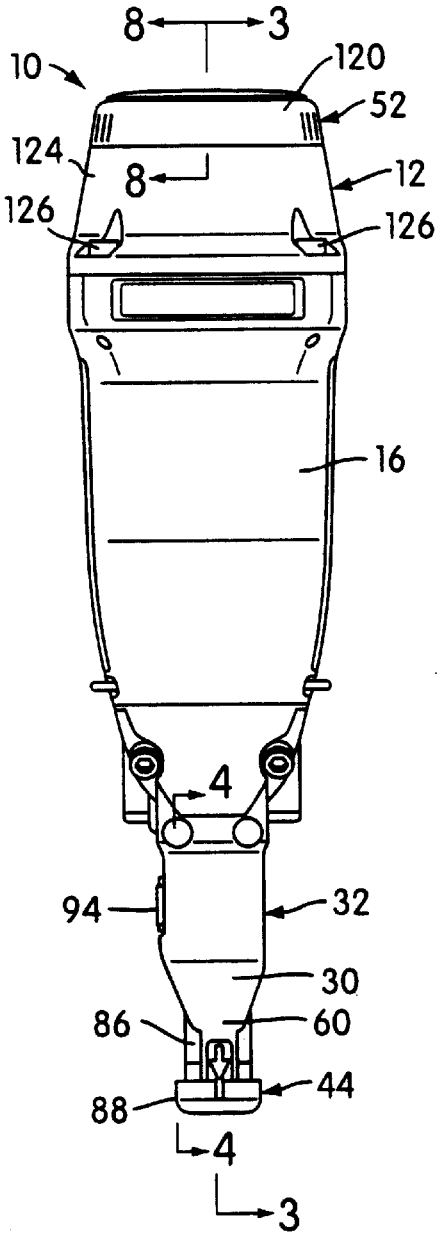
FIG. 2 is a front elevational view of the device shown in FIG. 1.

Referring now more particularly to the drawings, there is shown therein a fastener driving device, generally indicated at 10, which embodies the principles of the present invention. While the device could be adapted to drive any type of fastener, as shown, the device 10 is particularly adapted to drive finishing nails which are supplied in the form of an angled stick package.

The fastener driving device 10 includes a housing or frame structure, generally indicated at 12, which provides a handle portion 14 constructed and arranged to be gripped by a user enabling the user to handle the device 10 in portable fashion. The frame structure 12 also provides structure 16 extending generally perpendicular to the handle portion which constitutes a portion housing an air pressure cylinder 18 within the frame structure 12. Slidably mounted within the cylinder 18 is a piston assembly 20 which divides the cylinder 18 into a drive chamber 22 on one side of the piston assembly 20 and a return chamber 24 on the opposite side thereof. A fastener driving element 26 is operatively connected with the piston assembly 20 and extends therefrom through a resilient bumper 28 in the bottom of the return chamber 24. The lower end portion of the fastener driving element 26 is slidably mounted within a drive track 30 defined at its outer end by a nosepiece structure, generally indicated at 32, which is operatively fixed with respect to the frame structure 12.

The cylinder 18 and piston assembly 20 form a part of a manually actuated air pressure operated fastener driving system, generally indicated at 34, which is carried by the frame structure 12 and is constructed and arranged to move the piston assembly 20 and fastener driving element 26 through successive operating cycles, each including a drive stroke and a return stroke.

The air pressure operated fastener driving system 34 also includes a reservoir 36 which is formed in the handle portion 14, the construction of which is hollow. The reservoir 36 receives air under pressure from a source through a fitting (not shown) and communicates the supply of air under pressure therein to a space surrounding the upper end of the cylinder 18.

The air pressure surrounding the upper end of the cylinder 18 is controlled by a pilot pressure actuated main valve assembly, generally indicated at 38. Pilot pressure for operating the main valve assembly 38 comes from the reservoir 36 and is under the control of a manually actuated trigger valve assembly, generally indicated at 40. A pivoted trigger member 42 is mounted on the housing structure 12 in a position below the handle portion 14 to be engaged by an index finger of the user. A contact trip assembly 44 is mounted so as to extend outwardly of the nosepiece 32 to be actuated when the device 10 is moved into operative engagement with a workpiece. An enabling assembly 46 acting between the trigger member 42 and the contact trip assembly 44, with respect to the manually actuated trigger valve assembly 40 serves to enable the main valve assembly 38 to be manually actuated only when a sequential movement of first the contact trip assembly 44 and then the trigger member 42 is made in a manner hereinafter more specifically to be described.

The contact trip assembly 44 includes fastener depth adjusting mechanism, generally indicated at 48, capable of being conveniently manually adjusted in a manner hereinafter more specifically explained to determine the countersink depth of the driven fasteners.

The air pressure driving system also includes a plenum chamber return system, generally indicated at 50, for effecting movement of the piston assembly 20 through the return stroke thereof. The air displaced from the drive chamber 22 during the return stroke is discharged to atmosphere through an adjustable exhaust assembly, generally indicated at 52, carried by the frame structure 12 in a position above the pilot pressure operated main valve assembly 38.

A magazine assembly, generally indicated at 54, is mounted on the frame structure 12 for movement from an operative position into a intermediate fastener jam removing position and therebeyond into a separated condition with respect to the frame structure 12. A spring biased latch assembly, generally indicated at 56, is operatively connected between the magazine assembly 54 and the frame structure 12 and is operable to resiliently bias the magazine assembly 54 into its operative position enabling a rearward nosepiece portion 58 carried by the magazine assembly 54 to yieldingly move away from a forward nosepiece portion 60 forming a fixed portion of the frame structure 12. The spring biased latch assembly 56 when moved from the operative position thereof into an intermediate position is operable to resist the movement of the magazine assembly 54 out of its intermediate position. The spring biased latch assembly 56 is also movable from the intermediate position thereof into a separating position, enabling the magazine assembly 54 to be moved into a separated condition with respect to the frame structure 12.

The pilot pressure actuated main valve assembly 38 may be of any known and suitable construction. However, as shown, it is constructed generally in accordance with the structural teachings of U.S. Pat. No. 5,207,143 and operates in the same fashion as the operation disclosed therein. For the details of the operation, reference may be had to the '143 patent. For present purposes, it is sufficient to note that pilot pressure is normally allowed to communicate from the reservoir 36 to a pilot pressure chamber 62 which maintains a valve member 64 in closing relation to the upper end of the cylinder 18. When the pilot pressure is relieved from the pilot pressure chamber 62, the pressure surrounding the upper end of the cylinder 18 acts on the main valve member 64 to move it from its normally closed position with respect to the upper end of the cylinder 18 into a spaced position allowing the air under pressure surrounding the upper end of the cylinder 18 to enter therein and drive the piston assembly 20 with the fastener driving element 26 through a drive stroke. When pilot pressure is again established in the pilot pressure chamber 62 at the end of the drive stroke, the main valve member 64 is moved back into the closed position thereof, allowing a discharge opening 66 to communicate with the drive chamber 22 of the cylinder 18.

Figure 3:
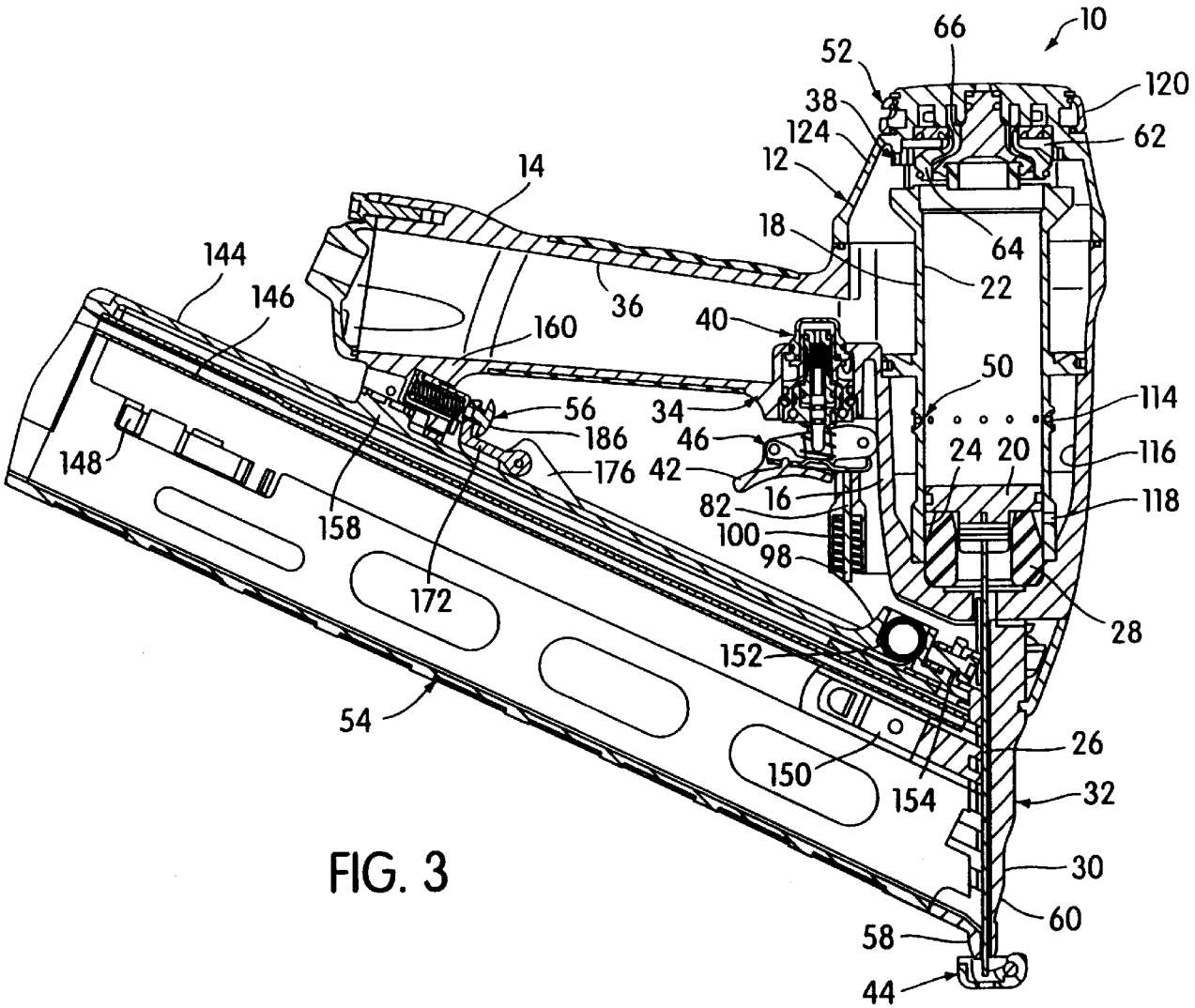
FIG. 3 is a sectional view taken along the line 3—3 of FIG. 2.

The trigger valve assembly 40, like the main valve assembly 38, can be of any known or suitable construction. As shown, the trigger valve assembly 40 is generally constructed in accordance with the structural teachings disclosed in U.S. Pat. No. 5,083,694, and operated in the same way as described therein. For the details of the operation, reference may be had to the '694 patent specification. For present purposes, it is sufficient to note that the trigger valve assembly 40 includes an actuating member 68 biased into a normal inoperative position by a spring 70. In its inoperative position, as shown in FIGS. 3 and 9, the actuating member 68 conditions the trigger valve assembly 40 to communicate air pressure in the reservoir 36 with the is pilot pressure chamber 62 of the main valve assembly 38 to thus retain the valve member 64 in cylinder closing relation. The movement of the actuating member 68 from the inoperative position thereof against the bias of spring 70 into the operative position thereof conditions the trigger valve assembly 40 to discontinue the communication of the reservoir air pressure with the pilot pressure chamber 62 and dump the air pressure in the pilot pressure chamber 62 to atmosphere.

As best shown in FIG. 9, the trigger member 42 is pivoted, as indicated at 72, at a forward end thereof to the frame structure 12. The enabling assembly 46 includes an enabling member 74 pivoted, as indicated at 76, to a rearward end of the trigger member 42. The enabling assembly 46 also include a compression coil spring 78 which is disposed in surrounding relation to a depending lower portion of the actuating member 68. An upper end of the coil spring 78 is fixed with respect to the handle portion 14 of the frame structure 12. A lower end of the coil spring 78 engages the upper surface of the central portion of the enabling member 74. The enabling member 74 has a forward end portion 80 which is disposed in cooperating relation with an upper end portion 82 of an upper structure 84 forming a part of the work contact assembly 44.

The work contact assembly 44 also includes a lower structure 86 having a lower end portion disposed below the end of the nosepiece structure 32. The lower structure 86 is made up of a metal rod bent into an inverted U-shaped configuration with the bight portion bent to seat within a work contact element 88.

The fastener depth adjusting assembly 48 serves to interconnect the upper and lower structures 84 and 86 and is constructed and arranged to be manually adjusted to change the relative positions of the upper and lower structures 84 and 86 between (1) a first position of adjustment wherein when the work contact assembly 44 is in its operative position the work contact element 88 extends downwardly from the nosepiece structure 32 a first extent and a fastener driven into a workpiece by the fastener driving element 26 has a minimum workpiece penetration and (2) a second position of adjustment wherein when the work contact assembly 44 is in its operative position the work contact element 88 extends from the nosepiece structure 32 a second extent and a fastener driven into a workpiece by the fastener driving element 26 has a maximum workpiece penetration.

It will be understood that the need to adjust the depth that a fastener penetrates into the workpiece is particularly desirable when the fastener being driven is a finishing nail. Usually, the head of a finishing nail will be countersunk, although at times, it may be desirable to leave the head of the fastener above the workpiece surface. The depth adjusting assembly 48 has a range of adjustment that allows for a depth of penetration where the head is not only not countersunk but spaced above the workpiece surface as well.

Where finishing nails are used as the fastener, as preferred here, counter-sinking is more important than with full headed nails, which are usually not driven beyond being flush with the workpiece surface.

As best shown in FIGS. 1–5, the lower structure 86 terminates at its lower end in a U-shaped portion 90 which includes a relatively thick bight section 92. Disposed between the upper and lower legs of the U-shaped portion 90 is a rotary adjusting member 94, constituting an essential part of the depth adjusting assembly 48. The rotary adjusting member 94 is mounted between the U-shaped portion legs for free rotational movement about an axis generally parallel with the axis of the cylinder 18. The legs of the U-shaped portion 90 mount the rotary adjusting member 94 against relative axial movement. The rotary movement is restricted to a single axis by exteriorly threading an upward extension 96 of one of the legs of the inverted U-shaped lower structure 86 and threadedly engaging the same within an interiorly threaded central axial section of the rotary adjusting member 94. The rotary adjusting member 94 is thus mounted on the lower structure 86 so that a rotational movement thereof with respect to the lower structure 86 will result in a relative axial movement thereof with respect to lower structure 86.

Figure 7:
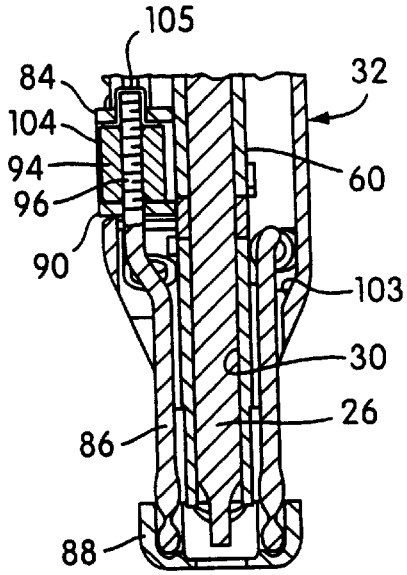
FIG. 7 is an enlarged fragmentary sectional view taken along the line 7—7 of FIG. 1.

As best shown in FIG. 3, the upper end portion 82 of the upper structure 84 extends vertically and is mounted on the frame structure 12 in a lower rearward position on the cylinder housing portion 16 for vertical sliding movement. The upper end portion 82 of the upper structure 84 connects at its lower extremity with a laterally extending portion 98 and has a coil spring 100 surrounding the same with a lower end engaging the laterally extending portion 98 and an upper end engaged with the frame structure 12. The coil spring 100 serves to resiliently bias the upper structure 84 downwardly into a limiting position corresponding with the inoperative position of the work contact assembly 44. In this limiting position, the lower surface of the U-shaped portion 90 engages an upwardly facing stop surface 101 on the forward nosepiece portion 60, as shown in FIG. 7.

When the device 10 is moved into cooperating relation with a workpiece, both the lower structure 86 and upper structure 82, which are held together by the fastener depth adjusting assembly 48, are moved upwardly together into an operative position against the bias of spring 100.

TRIGGER AND WORK CONTACT OPERATION

FIG. 9 illustrates the normal inoperative position of the actuating member 68, trigger member 42, enabling member 74 and the upper end portion 82 of the work contact assembly 44. It will be noted that the end 80 of the enabling member 74 overlies the upper end portion 82 of the work contact assembly 44. FIG. 10 illustrates the position of the parts after the user has moved the device 10 into cooperating relation with a workpiece. During this movement, the work contact member 88 engages the workpiece and effects an upward movement of the work contact assembly 44 from its normal inoperative position into an operative position. FIG. 10 shows that the upward movement of the end portion 82 of the work contact assembly 44 through a vertical path associated with this movement has moved the enabling member 74 so that its outer end 80 is moved through a first arcuate path.

Since the enabling member pivot pin 76 remains stationary during this movement, the central portion of the enabling member 74 will engage the lower end of the actuating member 68 but will not move it appreciably as is shown in FIG. 10. That is, the amount of upward movement of the actuating member 68 is insufficient to cycle the air pressure within the pilot pressure chamber 62 of the main valve assembly 38. Consequently, in response to the movement of the work contact assembly 44 of the device 10 into contact with the workpiece surface, there will be no power actuation which takes place.

FIG. 11 illustrates the sequential movement of the trigger member 42 into an operative limiting position thereof after the nosepiece structure 32 has been moved into engagement with the workpiece. This trigger member movement, which is stopped by the engagement of the trigger member 12 with the adjacent frame structure 12, will effect a movement of the enabling member 74 into its operative position. In this operative position, the central portion of the enabling member 74 has been moved upwardly a distance sufficient to move the actuating member 68 into the actuating or operative position thereof to thereby effect a cyclical movement of air within the pilot pressure chamber 62 and actuate the main valve assembly 38. In this regard, it will be noted that the trigger member 42 is simply moved upwardly about its pivot 72 which carries with it the forward end of the enabling member 74 since the end 80 thereof is engaged with the extremity of the upper end portion 82 of the work contact assembly 44.

FIG. 12 illustrates the position of the parts immediately following the normal rebound which occurs at actuation. The rebound serves to move the entire device 10 away from the workpiece, thus allowing the upper end portion 82 of the work contact assembly 44 to move downwardly as shown in FIG. 12. FIG. 12 shows the work contact assembly 44 moved fully into the inoperative position thereof. It is evident from the drawing that the end of the enabling member 74 will move out of contact with the upper end of the work contact assembly 44 after a predetermined amount of movement which is less than the total amount of movement required to reach the inoperative position.

During this movement of the enabling member 74, the end 80 of the enabling member 74 moves under the action of the spring 78 through a second arcuate path. At the end of the second arcuate path, the end of the enabling member 80 is disposed out of the vertical rectilinear path of the upper end portion 82 of the work contact assembly 44. However, it will be noted that the amount of movement of the central portion of the enabling member 74 is sufficient to allow the actuating member 68 to be moved by the spring 70 from its operative position into its normal inoperative position. This cycles the air pressure within the pilot pressure chamber and signals the return stroke by the plenum chamber return system 50.

FIG. 13 illustrates two other circumstances. First, FIG. 13 illustrates that, once the parts reach the position shown in FIG. 12, it is necessary for the trigger member 42 to be returned into its normal inoperative position with the device 10 disposed away from the workpiece in order to recondition the parts into the position shown in FIG. 9 so that another actuation can take place. If the user moves the device 10 back into contact with the workpiece immediately after recoil and then releases the trigger member 42 to allow it to move into its normal inoperative position under the urging of the spring 78, the end 80 of the enabling member 74 will be moved into a third arcuate path during which it will engage the upper end portion 82 and prevent the trigger member 42 from returning into its normal inoperative position. The trigger member 42 will only return into its normal inoperative position after the device 10 is then moved away from the workpiece surface.

The other circumstance, illustrated by FIG. 13, is that, when the parts are in their inoperative positions as shown in FIG. 9 and the trigger member 42 is moved into its operative position before the device 10 is moved into cooperating relation with the workpiece, the movement of the trigger member 42 will effect a movement of the end 80 of the enabling member 74 through a fourth path in which the end 80 ends up in the same position as when moved through the second arcuate path as shown in FIG. 12. This movement of the enabling member 74 with the trigger member 42, as shown in FIG. 13, is insufficient to effect a movement of the actuating member 68 out of its normal inoperative position and, hence, no actuation will occur. If, after the trigger member 42 has been moved into the position shown in FIG. 13, the user moves the device 10 into cooperating relation with the workpiece, the upper end portion 82 of the work contact assembly 44 will be moved upwardly through its vertical rectilinear path but, since the end 80 of the enabling member 74 is not in this path of movement, there will be no actuation.

The fastener depth adjusting assembly 48 interconnects the lower structure 86 with the upper structure 82 in a manner which enables the vertical position of the work contact element 88 to be adjusted between a maximum position below the lower end of the nosepiece structure 32 corresponding with maximum fastener workpiece penetration and a minimum position therebelow corresponding with a minimum fastener workpiece penetration.

Figure 4:
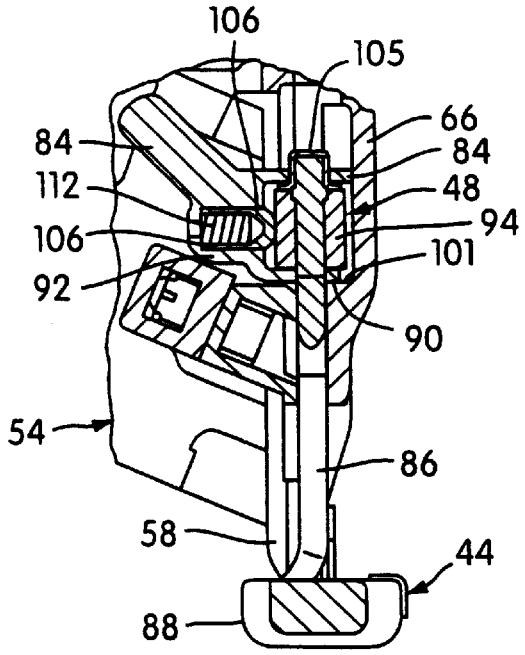
FIG. 4 is an enlarged fragmentary sectional view taken along the line 4—4 of FIG. 2.

As best shown in FIG. 7, the maximum position is determined by the bent end of a short leg portion of the inverted U-shaped lower structure 86 engaging stop surface 103 on the forward nosepiece portion 60. This interengagement also prevents the lower structure 86 from being adjusted to a position that allows it to fall off. As best shown in FIG. 4, the minimum position is determined by the end of the threaded leg portion 96 engaging a stop cap 105 carried by the U-shaped portion 90.

Figure 5:
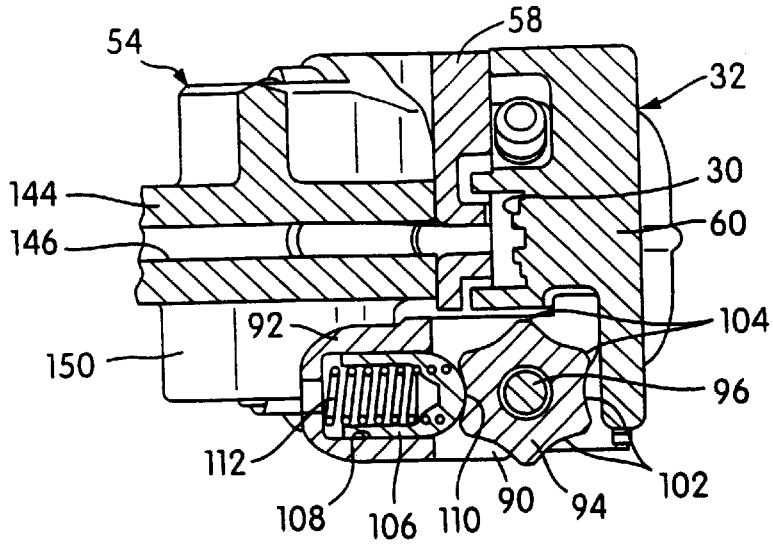
FIG. 5 is an enlarged fragmentary sectional view taken along the line 5—5 of FIG. 1.
Figure 6:
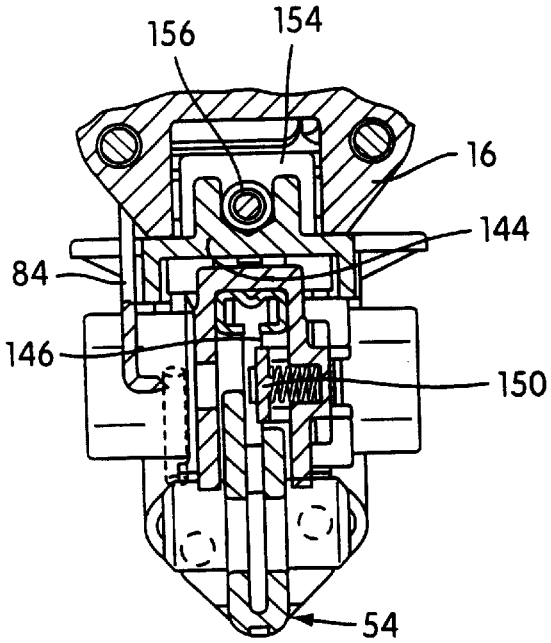
FIG. 6 is an enlarged fragmentary sectional view taken along the line 6—6 of FIG. 1.

As best shown in FIG. 5, the exterior peripheral surface of the rotary adjusting member 94 is formed with a series of axially extending recesses 102 spaced apart by a series of axially extending ridges 104. This configuration renders the total exterior surface 102–104 of the rotary adjusting member 94 particularly suited to be manually rotated by a manual rolling action.

To render the manual movement of the rotary adjusting member 94 more convenient to the user, the U-shaped portion 90 is mounted at one side of the nosepiece structure 32 midway between the lower end of the cylinder housing portion 16 of the frame structure 12 and the work contact element 88. In order to keep the rotary adjusting 94 from being easily rotated in its convenient position by unwanted or accidental engagements, the fastener depth adjusting assembly 48 includes a yieldable holding member 106.

As best shown in FIG. 5, the holding member 106 is mounted within a cylindrical bore 108 in the bight section 92. An outer end portion 110 of the holding member 106 is shaped to engage within an aligned rotary member recess 102 while also engaging the ridges 104 which separate the aligned recess 102 from the recesses 102 adjacent thereto. The holding member 106 is hollow rearwardly of the outer end portion 110 so as to house a coil spring 112 therein. One end of the coil spring 112 engages the bight section 92 while the other engages the end portion 110 of the holding member 106. The spring 112 thus resiliently biases the outer end portion 110 of the holding member 106 outwardly into engagement with the aligned rotary member recess 102 and adjacent ridges 104 and enables the holding member 106 to yieldingly move against the action of the spring 112 when the rotary adjusting member 94 is deliberately manually moved to a new adjusted position. Depending upon the direction of rotational movement manually imparted to the rotary adjusting member 94, one or the other of the adjacent ridges 104 will slidably engage the end portion 110 of the holding member 106 to effect the movement of the latter against the action of the spring 112. As the engaged ridge 104 continues to slide by the outer end portion 110, spring 112 will bias the holding member 106 into engagement with the adjacent recess 102. In this way, the depth of penetration of the fasteners into the workpiece is adjusted to any desirable position within the range of adjustment between maximum and minimum provided.

The plenum chamber return system 50 is of conventional nature and includes check valved openings 114 extending through the cylinder 18 into a surrounding plenum chamber 116 formed between the exterior of the cylinder 18 and the interior of the cylinder housing portion 16. As the piston assembly 20 moves toward the end of its drive stroke, the check valved openings 114 are uncovered and the air under pressure in the drive chamber 22 driving the piston assembly 20 is allowed to enter into the plenum chamber 116. The lower end of the plenum chamber 116 is communicated by an opening 118 through the cylinder into the return chamber 24 at the level of the bumper.

The bumper 28 is engaged by the lower surface of the piston assembly 20 at the end of the drive stroke and is arrested thereby. As soon as the pressure in the drive chamber 22 is relieved by the movement of the main valve assembly 38, the air pressure within the drive chamber 22 is communicated with the outlet opening 66 provided by the main valve assembly 38 communicating the air pressure within the drive chamber 22 with the adjustable exhaust assembly 52. As soon as the air pressure is relieved, the air pressure which is contained in the plenum chamber 116 acts on the lower end of the piston assembly 20 so as to effect a return stroke thereof. The air within the drive chamber 22 displaced by the movement of the piston assembly 20 through its return stroke is discharged through the outlet opening 66 into the adjustable exhaust assembly 52 and, from there, into the atmosphere.

Figure 8:
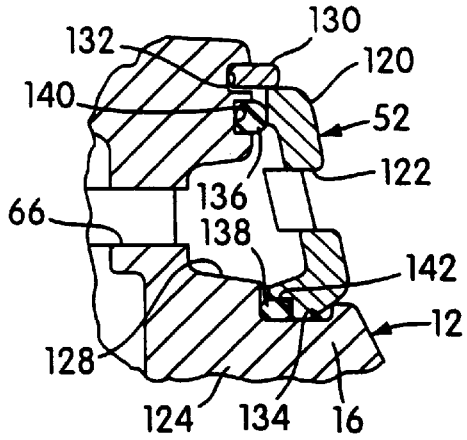
FIG. 8 is an enlarged fragmentary sectional view taken along the line 8—8 of FIG. 2.

The adjustable exhaust assembly 52 includes an adjustable exhaust air direction member 120 having a radially extending exhaust outlet 122. The adjusting member is freely rotated on the top of a removable cap member 124 fixed to the upper end of the cylinder housing portion 16 of the frame structure 12 as by bolts 126. As best shown in FIG. 8, the cap member 124 at its upper end portion defines a radially extending outer terminal of the exhaust opening 66 which leads to an external annular recess 128 in the cap member 124.

The exhaust air directing member 120 surrounds the recess 128 and is freely rotatably mounted on the upper end of the cap member 124 by mounting structure in the form of a C-clip 130 engaged within an annular groove 132 in the upper extremity of the cap member 124. In operation, the C-clip 130 overlies the upper surface of the exhaust air directing member 120 with the lower surface thereof extending in an upwardly facing annular groove 134 in the cap member 124.

Annular resilient sealing structure, in the form of upper and lower O-ring seals 136 and 138 respectively are constructed and arranged (1) to ensure that air displaced into said exhaust opening 66 is discharged into the atmosphere through the radially outwardly extending exhaust outlet 122 in a direction determined by the rotational position of the exhaust air directing member and (2) to yieldingly retain exhaust air directing member in any rotational position into which it is manually moved.

The upper O-ring seal 136 is disposed within an O-ring seal groove 140 formed in the exterior periphery of the cap member 124 and engages an annular surface in an inturned upper edge of the exhaust air directing member 120. The lower O-ring seal 138 is disposed within an annular notch 142 formed in a lower corner of an inturned lower edge of the exhaust air directing member 120 and engages in the inner corner of the groove 134. As shown, the lower O-ring seal 138 is compressed somewhat to provide for the resilient yielding movement of the exhaust air directing member 120 although upper O-ring seal also plays a part.

The magazine assembly 54 may also embody any well known or suitable construction. As previously indicated, the magazine assembly 54 is particularly adapted to receive and handle angled stick packages of finishing nails. As such, the magazine assembly 54 includes a magazine frame structure 144 which provides fixed structure defining a fastener feed track 146 for supporting an angled stick package of finishing nails along their angularly arrayed heads and for guiding the leading nail of the package into the drive track 30.

The magazine frame structure 144 leaves the rearward end of the drive track 146 open in order to enable the user to load new fastener stick packages therein. A one way clutch structure 148 is disposed in cooperating relation to the feed track 146 at its rearward end and is constructed and arranged to allow fastener stick packages to be moved forward thereby but to prevent subsequent rearward movement thereof (unless manually released). The one way clutch structure 148 cooperates with a one way pusher assembly 150 which is capable of moving with a resilient yielding action rearwardly past a fastener stick package held against rearward movement by the one way clutch structure 148. Once the one way pusher assembly 150 is moved beyond the rearwardmost fastener of the fastener stick package, the pusher of the pusher assembly 150 is biased to moved into the center of the drive track to engage the rearwardmost fastener and feed the package along the feed track 146.

As best shown in FIG. 3, the pusher assembly 150 effects the feeding movement by a negator spring 152 carried by the upper forward portion of the magazine frame structure 144 and connected with the pusher assembly 150.

Figure 14:
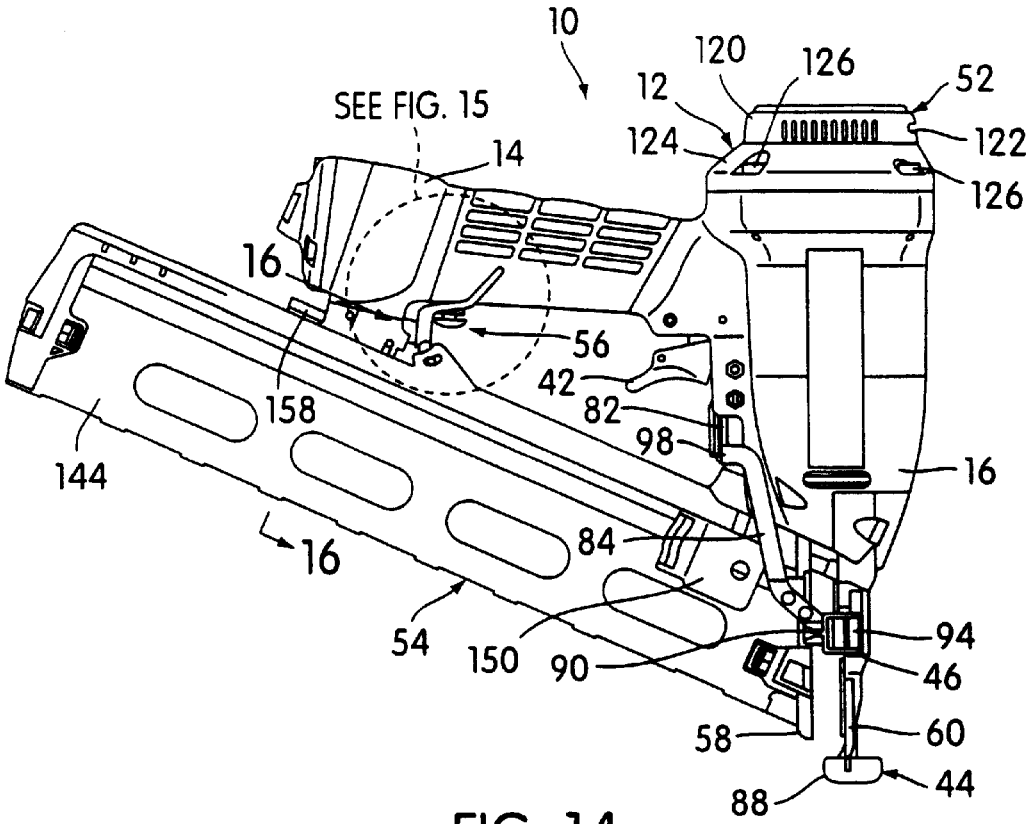
FIG. 14 is a view similar to FIG. 1 showing the magazine assembly in an intermediate joint clearing position.
Figure 15:
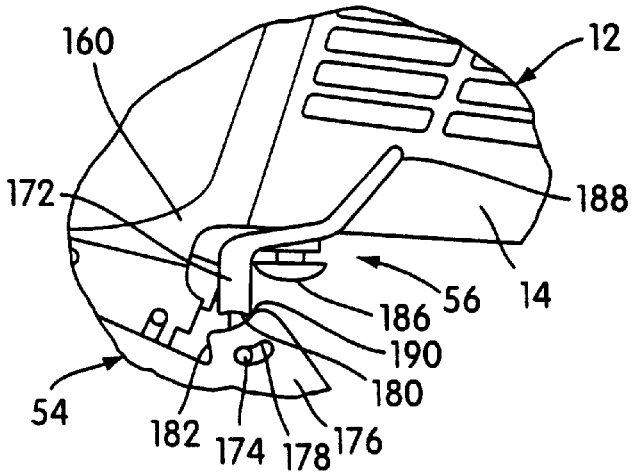
FIG. 15 is an enlarged portion of the device shown indicated by the phantom circle 15.
Figure 16:
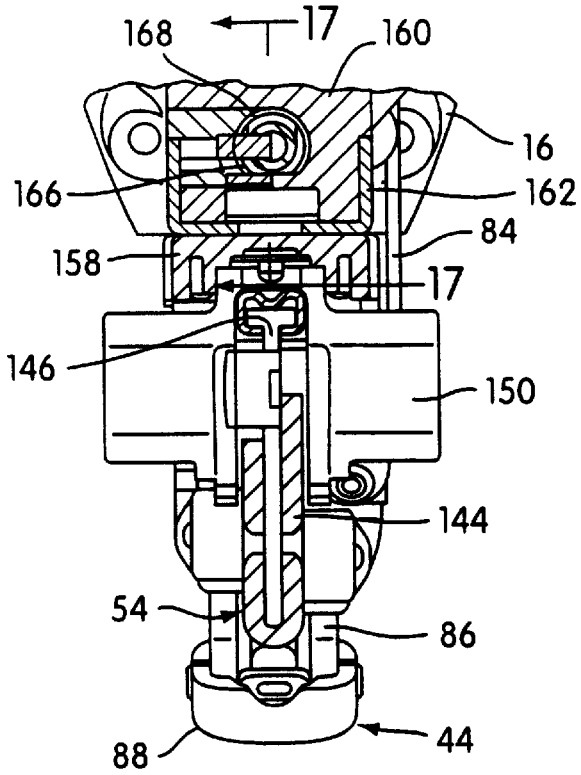
FIG. 16 is an enlarged fragmentary sectional view taken along the line 16—16 of FIG. 14.
Figure 18:
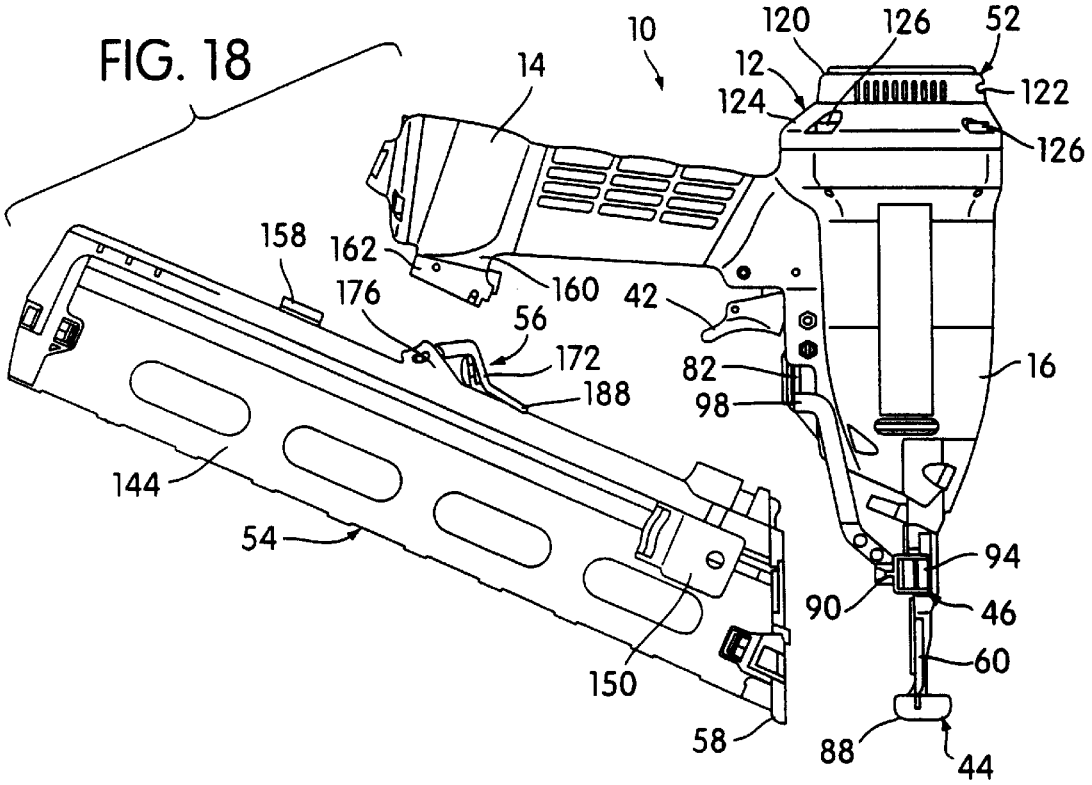
FIG. 18 is a view similar to FIG. 15 showing the magazine assembly in a separated condition.

As previously stated, the magazine assembly 54 is movable with respect to the frame structure 12 of the device 10. To this end, the magazine frame structure 144 provides a forward female guide structure 154 at its upper forward end which cooperates with a male guide structure 156 extending upwardly and rearwardly from the upper rearward portion of the nosepiece structure 32 as is best shown in FIGS. 14 and 18.

Mounted on the magazine frame structure 144 in rearwardly spaced relation from the forward guide structure 154 is a rearward guide structure 158 of generally T-shaped cross-sectional configuration. Formed on the lower rearward edge of the handle portion 14 is a depending frame section 160 on which is mounted an inverted U-shaped plate member 162. The rearward end of the depending frame section 160 is recessed and the rearward end of the bight portion of the invented U-shaped plate member is slotted to guidingly receive the rearward guide structure 158 on the magazine frame structure 144.

Figure 17:
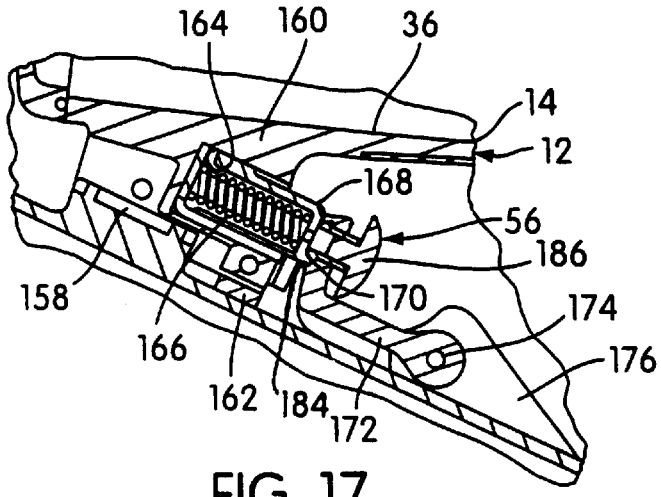
FIG. 17 is a fragmentary sectional view taken along the line 17—17 of FIG. 16.

As best shown in FIG. 17, the forward end of the depending frame section 160 has a forwardly opening bore 164 therein within which a compression coil spring 166 is disposed. The inner end of the coil spring 166 seats within the end of the bore 164 and the outer end seats within the outer wall of a hollow locking member 168 which is slidably mounted within the bore 164. The outer wall of the hollow locking member 168 includes a lower protruding element 170.

The locking member 168 and spring 166 form a part of the spring biased latch assembly 56 which also includes an L-shaped latch member 172. A forward end of the latch member 172 is pivoted to the magazine frame structure 144 forwardly of the rearward guide structure 158, as by a pivot pin 174 extending between a spaced pair of upstanding latch receiving elements 176 on the magazine frame structure 144. The latch receiving elements 176 include short arcuate or kidney shaped openings 178 which slidably receive the ends of the pivot pin 174 therein.

As best shown in FIG. 1, the latch member 172 at a position rearwardly of the pivot pin 174 includes laterally extending portions defining forwardly locking surfaces 180 which are positioned to engage rearwardly facing lower projecting surfaces 182 on the upstanding elements 176 when the latch member 172 is in the normal operating position thereof, as shown in FIG. 1. Also, as shown in FIG. 17, when the latch member 172 is in the normal operating position thereof, an upwardly facing catch surface 184 on the forward end of the latch member 172 engages beneath the protruding locking element 170. In the normal operating position of the latch member 172, the spring 166 also presses the hollow locking member 168 against the end of a push button 186 mounted for limited reciprocating movement within the forward end of the latch member 172 above the catch surface 184.

It is important to note that, when the latch member 172 is in the normal operating position thereof, the spring 166 acts against the hollow locking member 168 which biases it forwardly and the engagement of the hollow locking member 168 in turn presses on the latch member 172 in such a way as to tend to pivot it about the pivot pin 174 but this pivotal movement is prevented by the engagement of catch surface 184 with the protruding locking element 170. Thus, the entire forward thrust imparted to the latch member 172 is transmitted directly to the magazine frame structure 144 through interengaging surfaces 180 and 182.

In this way, the magazine assembly 54 is resiliently biased into the normal operating position thereof, shown in FIGS. 1 and 3, wherein the rearward nosepiece portion 58 thereof engages the forward nosepiece 60 fixed to the frame structure 12. This forward biasing of the rearward nosepiece portion 58 enables a fastener improperly driven within the drive track 30 to yieldingly move the rearward nosepiece portion 58 rearwardly away from the forward nosepiece portion 60 to thereby alleviate a situation which otherwise might create a jam. In the event, that a fastener jam does occur, access to the drive track 30 can be obtained for purposes of clearing the jam by moving the latch member 172 from the normal operating position thereof into the intermediate jam clearing position thereof.

To this end, the latch member 172 includes an angled handle portion 188 extending from the free end thereof which can be engaged in the hand of a user while the user's finger pushes on the push button 186 in a rearward direction. The rearward movement of the push button 186 moves the hollow locking member 168 rearwardly against the bias of spring 166 thus disengaging the protruding locking element 170 from the catch surface 184 allowing the user to simultaneously move the handle portion 188 forward to allow the forwardly facing latch surfaces 180 to disengage from the lower projecting surfaces 182. As soon as the rearwardly moved push button 186 and the latch member 172 move out of the path of forwardly biased movement of the hollow locking member 168, the hollow locking member 168 will move forwardly to a limiting position.

The magazine frame structure 144 can be moved rearwardly with respect to the frame structure 12 to an intermediate jam clearing position, as shown in FIG. 14. In this position, the latch member 172 will have been moved into an intermediate position, as shown in FIG. 14, wherein the latch surfaces 184 engage upper projecting surfaces 190 on the upstanding elements 176 to resist further pivotal movement of the latch member 172. In this intermediate jam clearing position of the latch member 172, further rearward movement of the magazine frame structure 144 from the position shown in FIG. 14 will engage the latch member 172 against the spring biased hollow locking member 168. In this way, when the latch member 172 is in its intermediate jam clearing position, a resistance to further movement of the magazine assembly 54 beyond the intermediate jam clearing position shown in FIG. 17 is provided by the spring biased latch assembly 56.

As best shown in FIG. 18, when the latch member 172 is in its intermediate position, it is possible for the user to manually engage the angled handle portion 188 of the latch member 172 and move it forwardly. During this movement, the engagement of the latch surfaces 180 with the upper projecting surfaces 190 causes the ends of the pivot pin 174 to ride up within the pivot pin openings 178. When the latch member 172 reaches the separating position shown in FIG. 18, the magazine assembly 54 can be separated from the frame structure 12 as shown in FIG. 18.

It is recognized that, since the device is portable, it will not always be oriented in a manner to fit the directional words used herein which are accurate when the device is being operated on a horizontal upwardly facing surface.

Any U.S. patents or patent applications mentioned or cited hereinabove are hereby incorporated by reference into the present application.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A fastener driving device comprising a frame structure presenting a handle portion constructed and arranged to be gripped by a user enabling the user to handle the device in portable fashion;

nosepiece structure operatively fixed with respect to said frame structure defining a fastener drive track;

a fastener driving element slidably mounted in said drive track;

a manually actuated fastener driving system carried by said frame structure constructed and arranged to move said fastener driving element through successive operating cycles each including a drive stroke and a return stroke;

a magazine assembly carried by said frame structure having fixed structure defining a fastener feed track leading to said drive track and movable structure constructed and arranged to enable a package of fasteners to be loaded in said magazine assembly and fed along said feed track so that the leading fastener of the fastener package is moved into said drive track to be driven outwardly thereof into a workpiece during the drive stroke of the fastener driving element;

an actuating member constructed and arranged with respect to said frame structure to be moved rectilinearly in a direction generally parallel with said drive track between a normally biased inoperative position and an operative position;

a trigger member constructed and arranged with respect to said frame structure to be manually pivoted between an inoperative position and an operative limiting position thereabove;

a work contact assembly constructed and arranged with respect to said frame structure to be moved from a normally biased inoperative position into an operative position in response to the movement of said device into cooperating engagement with a workpiece;

said work contact assembly including an upper structure movable along a generally rectilinear path between an inoperative position corresponding with the inoperative position of said work contact assembly and an operative position thereabove corresponding to the operative position of said work contact assembly; and an enabling member having one end pivotally connected to said trigger member, an opposite end operatively associated with an upper end of said upper structure and a central portion disposed below a lower end of said actuating member;

a spring constructed and arranged with respect to said enabling member and said frame assembly to bias said enabling member into a normal inoperative limiting position with respect to said trigger member;

the opposite end of said enabling member being constructed and arranged with respect to the upper end of said upper structure so that when said enabling member and said trigger member are in the inoperative positions thereof movement of said upper structure from the inoperative position thereof into the operative position will move the opposite end of said enabling member through a first arcuate path into a first position of said enabling member during which the central portion thereof in inoperable to move said actuating member into the operative position thereof;

said enabling member when in said first position being constructed and arranged to move into a second position in response to the manual movement of said trigger member into the operative limiting position thereof during which the central portion of said enabling member is operable to move said actuating member into the operative position thereof;

the relationship between the enabling member, said trigger member and said upper structure being such that (1) said enabling member is retained in said second position so long as said trigger member and said work contacting assembly are retained in the operative positions thereof, and (2) when said enabling member is in said second position and said trigger member is retained in the operative limiting position thereof said enabling member will be moved into a third position in response to a predetermined movement of said upper structure toward the inoperative position thereof either by virtue of the normal rebound of the device at firing or by a manual movement of said device away from the workpiece;

the relationship between said actuating member and said enabling member being such that the movement of said enabling member between the second and third positions thereof is operable to allow said actuating member to move into the normally biased inoperative position thereof;

the opposite end of said enabling member being movable through a second arcuate path during the movement of said enabling member from the second position thereof into the third position thereof so as to be out of the rectilinear path of said upper structure if the upper structure is moved back into the operative position thereof while said trigger member is retained in the operative limiting position thereof;

the opposite end of said enabling member when said enabling member is in said third position being biased to move through a third arcuate path by the release of said trigger member from the manual movement thereof into the operative limiting position thereof;

the third arcuate path of movement of the opposite end of said enabling member being configured to move the opposite end of said enabling member (1) into a position overlying the upper end of said upper structure when said upper structure is disposed in the inoperative position thereof and (2) into abutting engagement with said upper structure when the upper structure is in the operative position thereof.

2. A fastener driving device as defined in claim 1 wherein said trigger member is pivoted at a forward end thereof to said frame structure, said enabling member being pivoted to a rearward end of said trigger member.

3. A fastener driving device as defined in claim 2 wherein said spring surrounds a depending lower end portion of said actuating member and has an upper end fixed with respect to said frame structure and a lower end engaged with the central portion of said enabling member.

4. A fastener driving device as defined in claim 1 wherein said work contact assembly include s a lower structure separate from said upper structure and a fastener depth adjusting assembly interconnecting said upper and lower structures constructed and arranged to be manually adjusted to change the relative positions of said upper and lower structures between (1) a first position of adjustment wherein said lower structure portion when said work contact assembly is in the operative position thereof extends from said nosepiece structure a first extent and a fastener driven into a workpiece by said fastener driving element has a minimum workpiece penetration and (2) a second position of adjustment wherein said lower structure portion when said work contact assembly is in the operative position thereof extends from said nosepiece structure a second extent and a fastener driven into a workpiece by said fastener driving element has a maximum workpiece penetration, said fastener depth adjusting assembly comprising rotary adjusting member having an internal threaded section extending along an axis threadedly mounted on one of said upper and lower structures so that a rotational movement of said adjusting member with respect to said one structure effects a relative axial movement therebetween;

mounting structure between another of said upper and lower structures and said adjusting member constructed and arranged to mount said adjusting member on said another structure so as to be freely rotatable about said axis while being restrained against axial movement with respect thereto;

said mounting structure positioning said adjusting member so as to present an exterior surface in an accessible exterior position on said frame structure;

said exterior surface having a shape facilitating manual rotational movement of said adjusting member by a manual rolling action thereon and a yieldable holding member mounted on said another structure for linear movement toward and away from the exterior surface of said adjusting member while being restrained against axial movement with respect thereto;

said yieldable holding member being spring biased to continuously engage the exterior surface of said adjusting member;

said yieldable holding member being constructed and arranged with respect to the exterior surface configuration of said adjusting member to continuously yieldably hold said adjusting member in a selected one of a series of rotational positions against free rotational movement in either direction while allowing manual rotational movements against the spring bias of said yieldable holding member in either direction with generally equal manual effort.

5. A fastener driving device as defined in claim 4 wherein said work contact assembly includes a spring operatively engaged with said upper structure constructed and arranged to resiliently bias said upper structure into a stop surface on said nosepiece structure when said work contact assembly is in the normal inoperative position thereof so as to resiliently resist movement therefrom into the operative position thereof.

6. A fastener driving device as defined in claim 5 wherein said mounting structure is fixed on the lower end of said upper structure and is of U-shaped configuration including spaced leg portions between which said rotary member is disposed and a bight portion between said leg portions having a bore within which said yieldable holding member is disposed.

7. A fastener driving device as defined in claim 6 wherein said lower structure includes a rod bent into an inverted elongated U-shaped configuration including a lower bight portion fixed with respect to a work contact element and leg portions extending upwardly therefrom, one of said leg portions having an end section extending above the other leg portion having external threads on which the internal threaded section of said adjusting member is threadedly mounted.

8. A fastener driving device as defined in claim 7 wherein the exterior surface includes a series of axially extending recesses spaced apart by a series of ridges.

9. A fastener driving device as defined in claim 8 wherein said trigger member is pivoted at a forward end thereof with respect to said frame structure, said enabling member being pivoted to a rearward end of said trigger member.

10. A fastener driving device as defined in claim 9 wherein said spring surrounds a depending lower end portion of said actuating member and has an upper end fixed with respect to said frame structure and a lower end engaged with the central portion of said enabling member.

11. A fastener driving device as defined in claim 4 wherein said nosepiece structure includes a rearward nosepiece portion forming a part of the fixed structure of said magazine assembly and a separate forward nosepiece portion fixed with respect to said frame structure, said forward and rearward nosepiece portions being operatively fixed together to define a fastener guiding portion of said drive track;

cooperating guide structure constructed and arranged to enable said magazine assembly to be moved (1) into a normal operating position in a direction to move said rearward nosepiece portion toward said forward nosepiece portion and into cooperating relation together and (2) from said normal operating position in an opposite direction into an intermediate position wherein said nosepiece portions are spaced apart and therebeyond into separated relation with respect to said frame structure; and a spring biased releasable latch assembly constructed and arranged with respect to said magazine assembly and said frame structure manually movable between (1) a normally operating position resiliently biasing said magazine assembly into the normal operating position thereof enabling the rearward nosepiece portion of said magazine assembly disposed together in cooperating relation with the forward nosepiece portion to be yieldingly moved therefrom, (2) an intermediate position wherein said magazine assembly is resiliently retained against movement beyond the intermediate position thereof to enable jammed fasteners to be removed from between the spaced apart rearward and forward nosepiece portions and (3) a separating position enabling said magazine assembly to be freely moved beyond the intermediate position into separated relation with respect to said frame structure.

12. A fastener driving device as defined in claim 11 wherein said manually actuated fastener driving system includes a cylinder within said frame structure;

a piston assembly slidably sealingly mounted within said cylinder and connected with said fastener driving element;

a reservoir for containing a supply of air under pressure a pilot pressure operated main valve assembly in the portion of the frame structure above said cylinder movable from a position wherein air pressure within said reservoir surrounding the upper end of said cylinder is prevented from communication with an open upper end of said cylinder into an operative position wherein the air pressure within said reservoir surrounding the upper end of said cylinder is communicated therewith to act on an upwardly facing area of said piston assembly to move said piston assembly and said fastener driving element through a drive strike;

a plenum chamber return system operable during an end portion of said drive stroke to communicate the air pressure acting on said upwardly facing area of said piston assembly into a plenum chamber surrounding said cylinder and a downwardly facing surface area of said piston assembly;

said pilot pressure operated main valve assembly being movable from said operative position into a position communicating the air under pressure acting on said upwardly facing surface area of said piston assembly with an exhaust opening therein and in the frame structure above said cylinder allowing the air pressure within said plenum chamber and the air pressure acting on said downwardly facing surface area of said piston assembly to effect a return stroke of said piston assembly during which the air in said cylinder above said piston assembly is displaced into said exhaust opening and an adjustable annular exhaust air directing member having a radially extending exhaust air outlet disposed in communicating relation with said exhaust opening allowing air displaced into said exhaust opening during the return stroke of the said piston assembly to communicate with said radially extending exhaust opening;

mounting structure constructed and arranged to mount said exhaust air directing member on said frame structure above said main valve assembly for free rotational movement about the axis of said cylinder; and annular resilient sealing structure acting between said exhaust air directing member and said frame structure constructed and arranged (1) to ensure that air displaced into said exhaust opening is discharged into the atmosphere through said radially outwardly extending exhaust outlet in a direction determined by the rotational position of said exhaust air directing member and (2) to yieldingly retain said exhaust air directing member in any rotational position into which it is manually moved.

13. A fastener driving device as defined in claim 4 wherein said manually actuated fastener driving system includes a cylinder within said frame structure;

a piston assembly slidably sealingly mounted within said cylinder and connected with said fastener driving element;

a reservoir for containing a supply of air under pressure a pilot pressure operated main valve assembly in the portion of the frame structure above said cylinder movable from a position wherein air pressure within said reservoir surrounding the upper end of said cylinder is prevented from communication with an open upper end of said cylinder into an operative position wherein the air pressure within said reservoir surrounding the upper end of said cylinder is communicated therewith to act on an upwardly facing area of said piston assembly to move said piston assembly and said fastener driving element through a drive strike;

a plenum chamber return system operable during an end portion of said drive stroke to communicate the air pressure acting on said upwardly facing area of said piston assembly into a plenum chamber surrounding said cylinder and a downwardly facing surface area of said piston assembly;

said pilot pressure operated main valve assembly being movable from said operative position into a position communicating the air under pressure acting on said upwardly facing surface area of said piston assembly with an exhaust opening therein and in the frame structure above said cylinder allowing the air pressure within said plenum chamber and the air pressure acting on said downwardly facing surface area of said piston assembly to effect a return stroke of said piston assembly during which the air in said cylinder above said piston assembly is displaced into said exhaust opening and an adjustable annular exhaust air directing member having a radially extending exhaust air outlet disposed in communicating relation with said exhaust opening allowing air displaced into said exhaust opening during the return stroke of the said piston assembly to communicate with said radially extending exhaust opening;

mounting structure constructed and arranged to mount said exhaust air directing member on said frame structure above said main valve assembly for free rotational movement about the axis of said cylinder; and annular resilient sealing structure acting between said exhaust air directing member and said frame structure constructed and arranged (1) to ensure that air displaced into said exhaust opening is discharged into the atmosphere through said radially outwardly extending exhaust outlet in a direction determined by the rotational position of said exhaust air directing member and (2) to yieldingly retain said exhaust air directing member in any rotational position into which it is manually moved.

14. A fastener driving device as defined in claim 1 wherein said nosepiece structure includes a rearward nosepiece portion forming a part of the fixed structure of said magazine assembly and a separate forward nosepiece portion fixed with respect to said frame structure, said forward and rearward nosepiece portions being operatively fixed together to define a fastener guiding portion of said drive track;

cooperating guide structure constructed and arranged to enable said magazine assembly to be moved (1) into a normal operating position in a direction to move said rearward nosepiece portion toward said forward nosepiece portion and into cooperating relation together and (2) from said normal operating position in an opposite direction into an intermediate position wherein said nosepiece portions are spaced apart and therebeyond into separated relation with respect to said frame structure; and a spring biased releasable latch assembly constructed and arranged with respect to said magazine assembly and said frame structure manually movable between (1) a normally operating position resiliently biasing said magazine assembly into the normal operating position thereof enabling the rearward nosepiece portion of said magazine assembly disposed together in cooperating relation with the forward nosepiece portion to be yieldingly moved therefrom, (2) an intermediate position wherein said magazine assembly is resiliently retained against movement beyond the intermediate position thereof to enable jammed fasteners to be removed from between the spaced apart rearward and forward nosepiece portions and (3) a separating position enabling said magazine assembly to be freely moved beyond the intermediate position into separated relation with respect to said frame structure.

15. A fastener driving device as defined in claim 14 wherein said spring biased releasable latch assembly includes a latch member mounted on the fixed structure of said magazine assembly for movement between said normal operating, intermediate, and separating positions, and a spring biased locking member mounted on said frame structure for engaging said latch member when in said normal operating position to thereby resiliently yieldingly maintain said magazine assembly in its normal operating position.

16. A fastener driving device as defined in claim 14 wherein said latch is disposed with a forward end thereof between two upstanding elements on the fixed structure of said magazine assembly, a shaft extending through the forward end of said latch member and aligned openings in said upstanding elements to allow said latch member limited longitudinal movement in addition to the pivotal movement thereof.

17. A fastener driving device as defined in claim 16 wherein said aligned openings are arcuate and said upstanding elements include lower generally rearwardly projecting surfaces and upper generally upwardly projecting surfaces, said latch member having forwardly facing surfaces engageable with said rearwardly projecting surfaces when said latch member is in the normally operating position thereof and for engaging the upwardly projecting surfaces when said latch member is in the intermediate position thereof.

18. A fastener driving device as defined in claim 17 wherein said locking member includes a locking element and said latch member includes an upwardly facing locking surface engaged beneath said locking element when said latch member is in the normal operating position thereof.

19. A fastener driving device as defined in claim 18 wherein said latch member carries a push button for relative movement with respect thereto, said push button when said latch member is in the normal operating position thereof being disposed in a position to move said locking member rearwardly to release said locking element from beneath said latch member locking surface, said latch member including a handle portion constructed and arranged to be manually gripped in such a way that said push button can be simultaneously digitally pushed.

20. A fastener driving device as defined in claim 14 wherein said manually actuated fastener driving system includes a cylinder within said frame structure;

a piston assembly slidably sealingly mounted within said cylinder and connected with said fastener driving element;

a reservoir for containing a supply of air under pressure a pilot pressure operated main valve assembly in the portion of the frame structure above said cylinder movable from a position wherein air pressure within said reservoir surrounding the upper end of said cylinder is prevented from communication with an open upper end of said cylinder into an operative position wherein the air pressure within said reservoir surrounding the upper end of said cylinder is communicated therewith to act on an upwardly facing area of said piston assembly to move said piston assembly and said fastener driving element through a drive strike;

a plenum chamber return system operable during an end portion of said drive stroke to communicate the air pressure acting on said upwardly facing area of said piston assembly into a plenum chamber surrounding said cylinder and a downwardly facing surface area of said piston assembly;

said pilot pressure operated main valve assembly being movable from said operative position into a position communicating the air under pressure acting on said upwardly facing surface area of said piston assembly with an exhaust opening therein and in the frame structure above said cylinder allowing the air pressure within said plenum chamber and the air pressure acting on said downwardly facing surface area of said piston assembly to effect a return stroke of said piston assembly during which the air in said cylinder above said piston assembly is displaced into said exhaust opening and an adjustable annular exhaust air directing member having a radially extending exhaust air outlet disposed in communicating relation with said exhaust opening allowing air displaced into said exhaust opening during the return stroke of the said piston assembly to communicate with said radially extending exhaust opening;

mounting structure constructed and arranged to mount said exhaust air directing member on said frame structure above said main valve assembly for free rotational movement about the axis of said cylinder; and annular resilient sealing structure acting between said exhaust air directing member and said frame structure constructed and arranged (1) to ensure that air displaced into said exhaust opening is discharged into the atmosphere through said radially outwardly extending exhaust outlet in a direction determined by the rotational position of said exhaust air directing member and (2) to yieldingly retain said exhaust air directing member in any rotational position into which it is manually moved.

21. A fastener driving device as defined in claim 1 wherein said manually actuated fastener driving system includes a cylinder within said frame structure;

a piston assembly slidably sealingly mounted within said cylinder and connected with said fastener driving element;

a reservoir for containing a supply of air under pressure a pilot pressure operated main valve assembly in a portion of the frame structure above said cylinder movable from a position wherein air pressure within said reservoir surrounding the upper end of said cylinder is prevented from communication with an open upper end of said cylinder into an operative position wherein the air pressure within said reservoir surrounding the upper end of said cylinder is communicated therewith to act on an upwardly facing area of said piston assembly to move said piston assembly and said fastener driving element through a drive strike;

a plenum chamber return system operable during an end portion of said drive stroke to communicate the air pressure acting on said upwardly facing area of said piston assembly into a plenum chamber surrounding said cylinder and a downwardly facing surface area of said piston assembly;

said pilot pressure operated main valve assembly being movable from said operative position into a position communicating the air under pressure acting on said upwardly facing surface area of said piston assembly with an exhaust opening therein and in the frame structure above said cylinder allowing the air pressure within said plenum chamber and the air pressure acting on said downwardly facing surface area of said piston assembly to effect a return stroke of said piston assembly during which the air in said cylinder above said piston assembly is displaced into said exhaust opening and an adjustable annular exhaust air directing member having a radially extending exhaust air outlet disposed in communicating relation with said exhaust opening allowing air displaced into said exhaust opening during the return stroke of the said piston assembly to communicate with said radially extending exhaust opening;

mounting structure constructed and arranged to mount said exhaust air directing member on said frame structure above said main valve assembly for free rotational movement about the axis of said cylinder; and annular resilient sealing structure acting between said exhaust air directing member and said frame structure constructed and arranged (1) to ensure that air displaced into said exhaust opening is discharged into the atmosphere through said radially outwardly extending exhaust outlet in a direction determined by the rotational position of said exhaust air directing member and (2) to yieldingly retain said exhaust air directing member in any rotational position into which it is manually moved.

22. A fastener driving device as defined in claim 21 wherein said frame structure includes a cylinder housing portion integral with said housing portion and a cap member bolted in sealing relation to said cylinder housing portion, said cap member containing a terminal end of said exhaust opening in the form of a radial passage therein leading into an exterior annular recess therein, said exhaust air directing member being rotatably mounted on said cap member so as to extend peripherally over said annular recess.

23. A fastener driving device as defined in claim 22 wherein a lower edge of said exhaust air directing member is rotatably received by an upwardly facing annular surface of said cap member spaced outwardly and below said annular recess, said mounting structure comprising a C-clip mounted in an annular groove in said cap member above said annular recess and extending above an upper edge of said exhaust air directing member.

24. A fastener driving device as defined in claim 23 wherein said annular resilient sealing structure comprises an upper annular O-ring seal acting between said cap member between said annular recess and said C-clip groove and an upper portion of said exhaust air directing member and a lower annular lower O-ring seal of resilient material compressed between the lower edge of said exhaust air directing member and the upwardly facing annular surface of said cap member.

* * * * *